US011047584B2

(12) United States Patent
Lee et al.

(10) Patent No.: US 11,047,584 B2
(45) Date of Patent: Jun. 29, 2021

(54) AIR CONDITIONER

(71) Applicant: Samsung Electronics Co., Ltd., Suwon-si (KR)

(72) Inventors: Jung Dae Lee, Seongnam-si (KR); Do Hoon Kim, Suwon-si (KR); Jae Hyoung Sim, Suwon-si (KR); Joon Ho Yoon, Suwon-si (KR); Kwang Min Lee, Suwon-si (KR); Bu Youn Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 277 days.

(21) Appl. No.: 15/761,690

(22) PCT Filed: Aug. 22, 2016

(86) PCT No.: PCT/KR2016/009246
§ 371 (c)(1),
(2) Date: Mar. 20, 2018

(87) PCT Pub. No.: WO2017/073896
PCT Pub. Date: May 4, 2017

(65) Prior Publication Data

US 2018/0356107 A1 Dec. 13, 2018

(30) Foreign Application Priority Data

Nov. 16, 2015 (KR) ..... 10-2015-0160746

(51) Int. Cl.
*F24F 1/0014* (2019.01)
*F24F 1/0047* (2019.01)
(Continued)

(52) U.S. Cl.
CPC ..... *F24F 1/0014* (2013.01); *F24F 1/0022* (2013.01); *F24F 1/0047* (2019.02);
(Continued)

(58) Field of Classification Search
CPC ..... F24F 1/0014; F24F 1/0047; F24F 1/0022; F24F 13/08; F24F 2013/0616
(Continued)

(56) References Cited

U.S. PATENT DOCUMENTS 6,168,517 B1 * 1/2001 Cook ..... F24F 7/007 454/269
8,616,842 B2 * 12/2013 Avedon ..... F04D 25/088 415/209.2
(Continued)

FOREIGN PATENT DOCUMENTS

CN 104456722 3/2015
EP 2206988 7/2010
(Continued)

OTHER PUBLICATIONS

Chinese Office Action dated Nov. 1, 2019 in Chinese Patent Application No. 2016800633514.
(Continued)

*Primary Examiner* — Steven B McAllister
*Assistant Examiner* — Charles R Brawner
(74) *Attorney, Agent, or Firm* — Staas & Halsey LLP

(57) ABSTRACT

Disclosed herein is a air conditioner. The air conditioner a housing including a suction port and a discharge port, a heat exchanger provided inside the housing, a blower fan configured to suction air through the suction port, pass and heat-exchange the air through the heat exchanger, and then discharge the air through the discharge port, and a sub-flow path that suctions and guides some air around the discharge port using a suction force of the blower fan to control the flowing direction of the air discharged from the discharge port.

9 Claims, 11 Drawing Sheets

(51) Int. Cl.
*F24F 1/0022* (2019.01)
*F24F 13/06* (2006.01)
*F24F 13/08* (2006.01)

(52) U.S. Cl.
CPC ..... *F24F 13/08* (2013.01); *F24F 2013/0616* (2013.01); *F24F 2221/28* (2013.01)

(58) Field of Classification Search
USPC ..... 454/233
See application file for complete search history.

(56) References Cited

U.S. PATENT DOCUMENTS 9,395,090 B2 * 7/2016 Corleoni ..... F24C 15/20
2002/0062948 A1 * 5/2002 Horttanainen ..... F24F 1/01 165/123
2010/0263829 A1 * 10/2010 Kimura ..... F24F 5/0089 165/59
2010/0303617 A1 * 12/2010 Chen ..... F04D 29/544 415/208.2
2011/0240004 A1 * 10/2011 Corleoni ..... F24C 15/20 126/299 R

FOREIGN PATENT DOCUMENTS

JP 6-193958 7/1997
JP 2005-249328 9/2005
JP 2006-336961 12/2006
JP 2007-40617 2/2007
JP 2007040617 A * 2/2007
KR 2000-0055145 9/2000
KR 10-2013-0088582 8/2013

OTHER PUBLICATIONS

Extended European Search Report dated Dec. 19, 2018 in European Patent Application No. 16860080.7.
International Search Report dated Nov. 9, 2016 in corresponding International Patent Application No. PCT/KR2016/009246.
European Office Action dated May 17, 2019 in European Patent Application No. 16860080.7.

* cited by examiner

【Fig. 1】
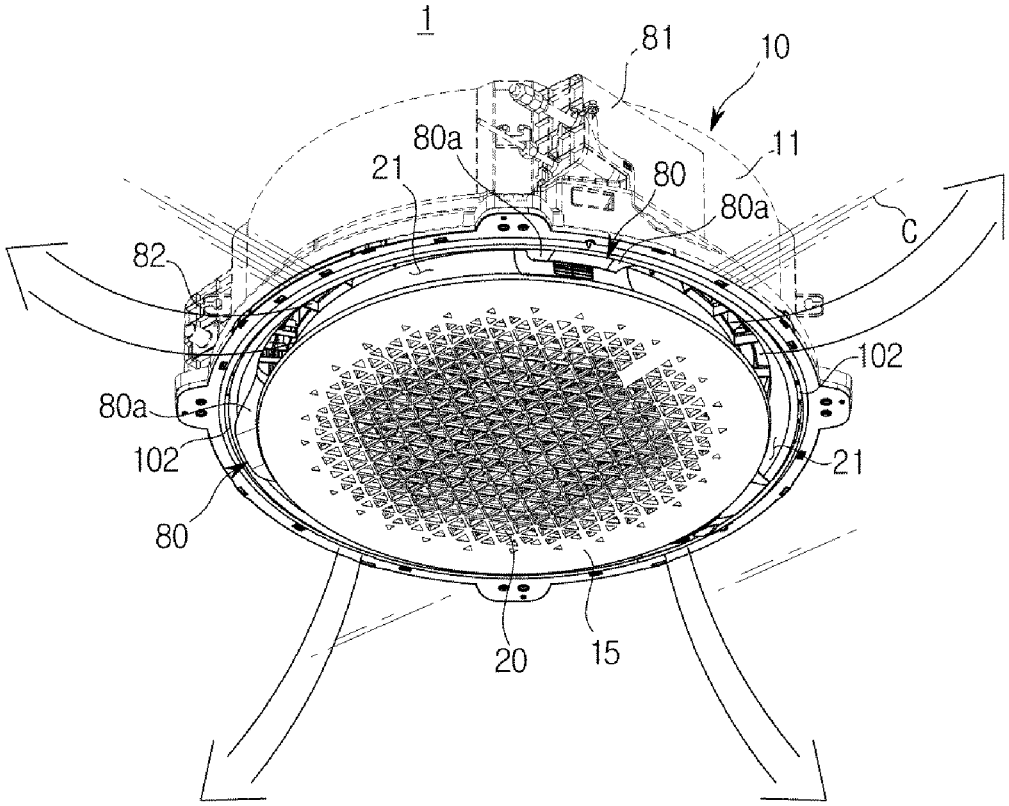

【Fig. 2】
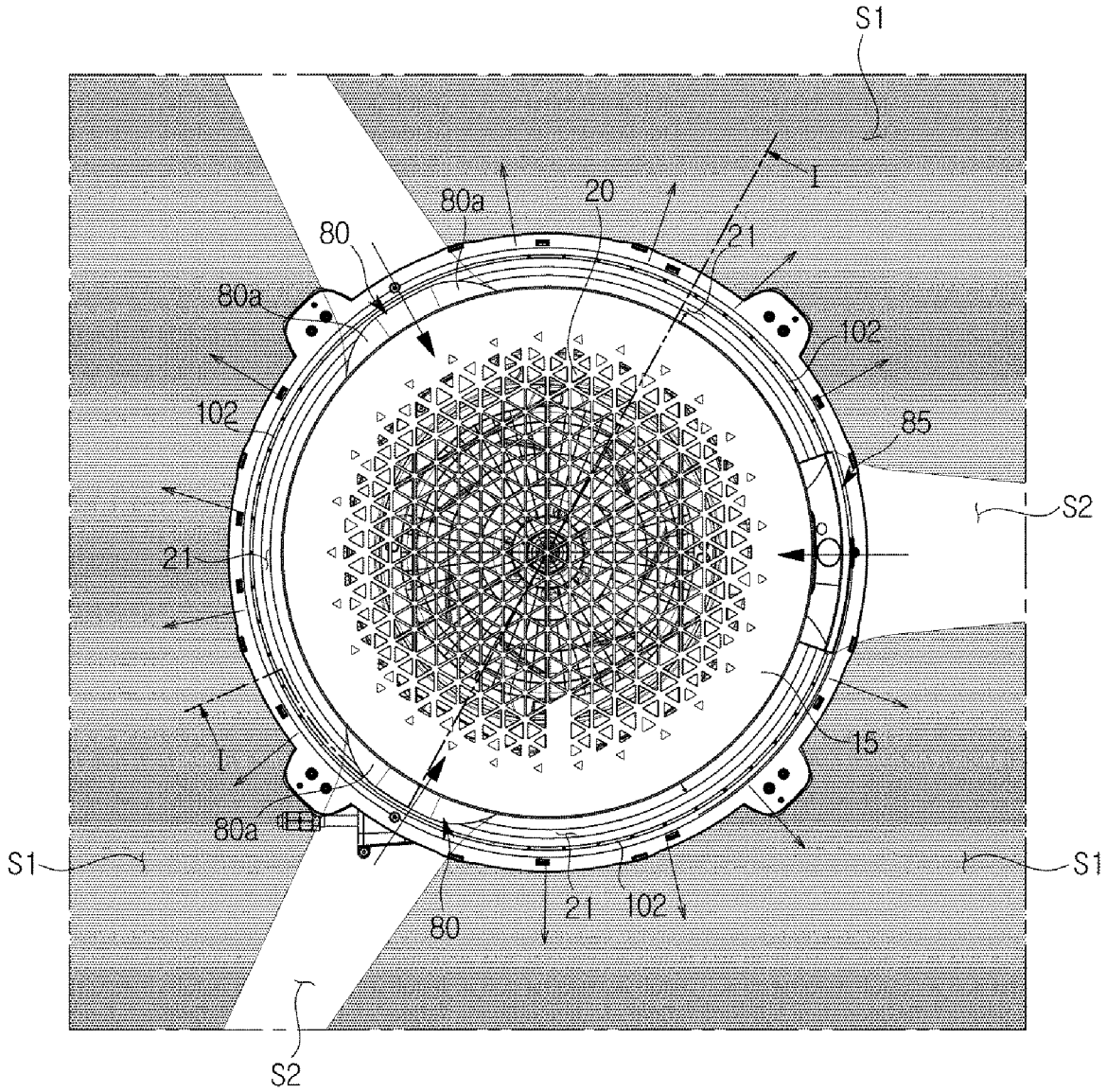

【Fig. 3】
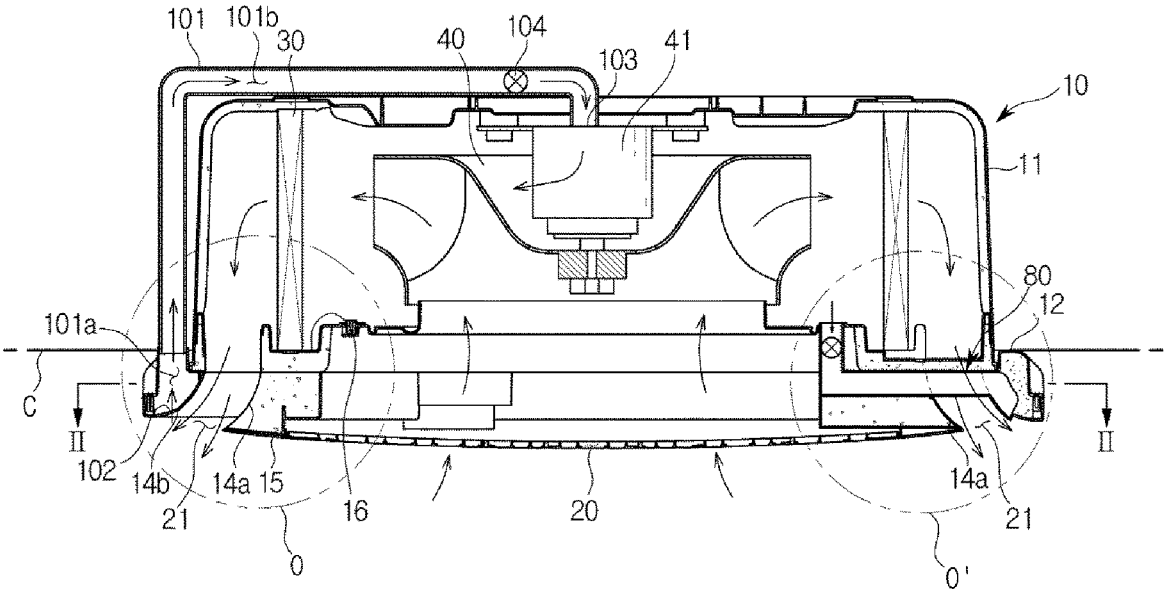

【Fig. 4】
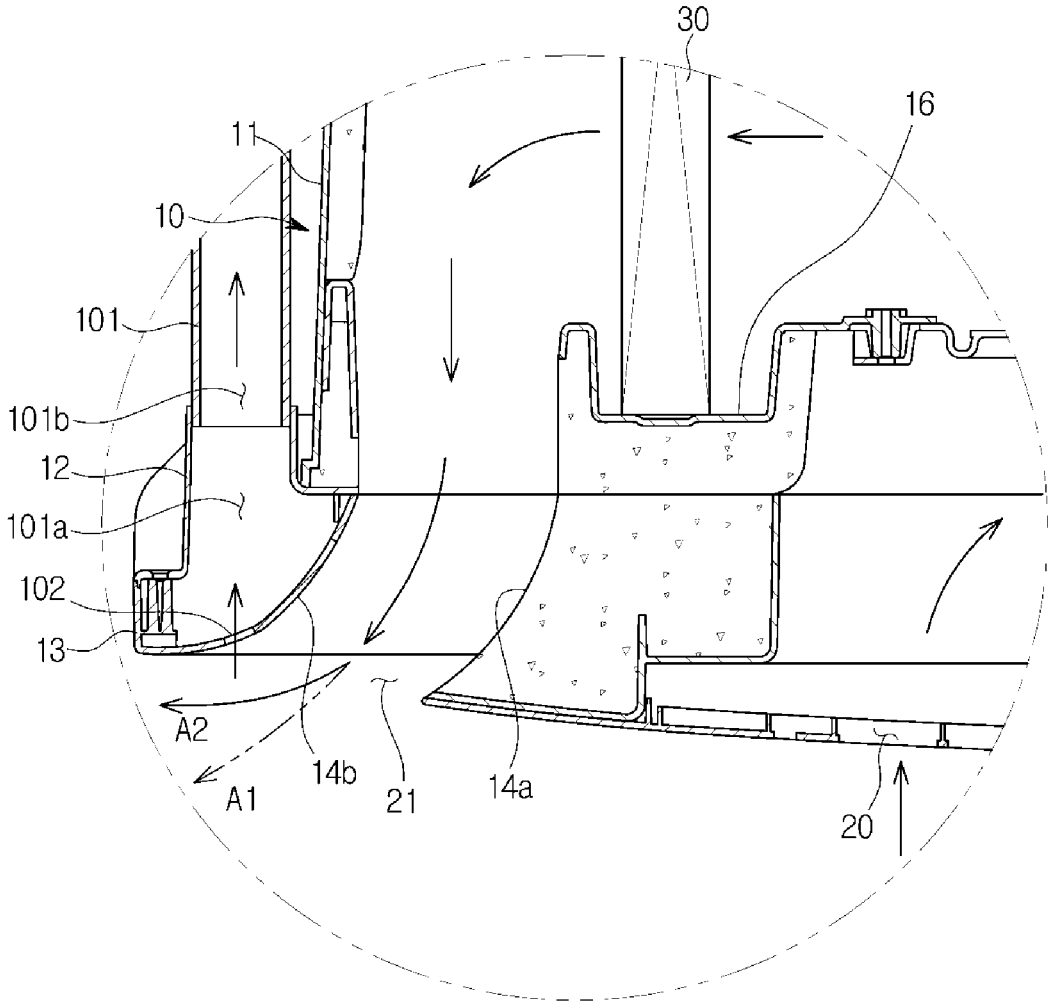

【Fig. 5】
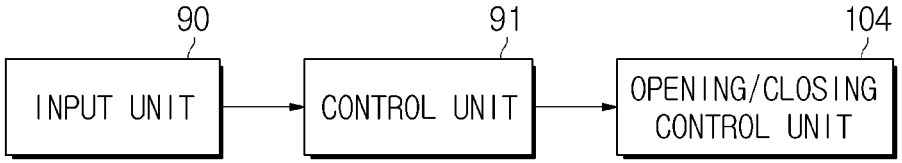

【Fig. 6】
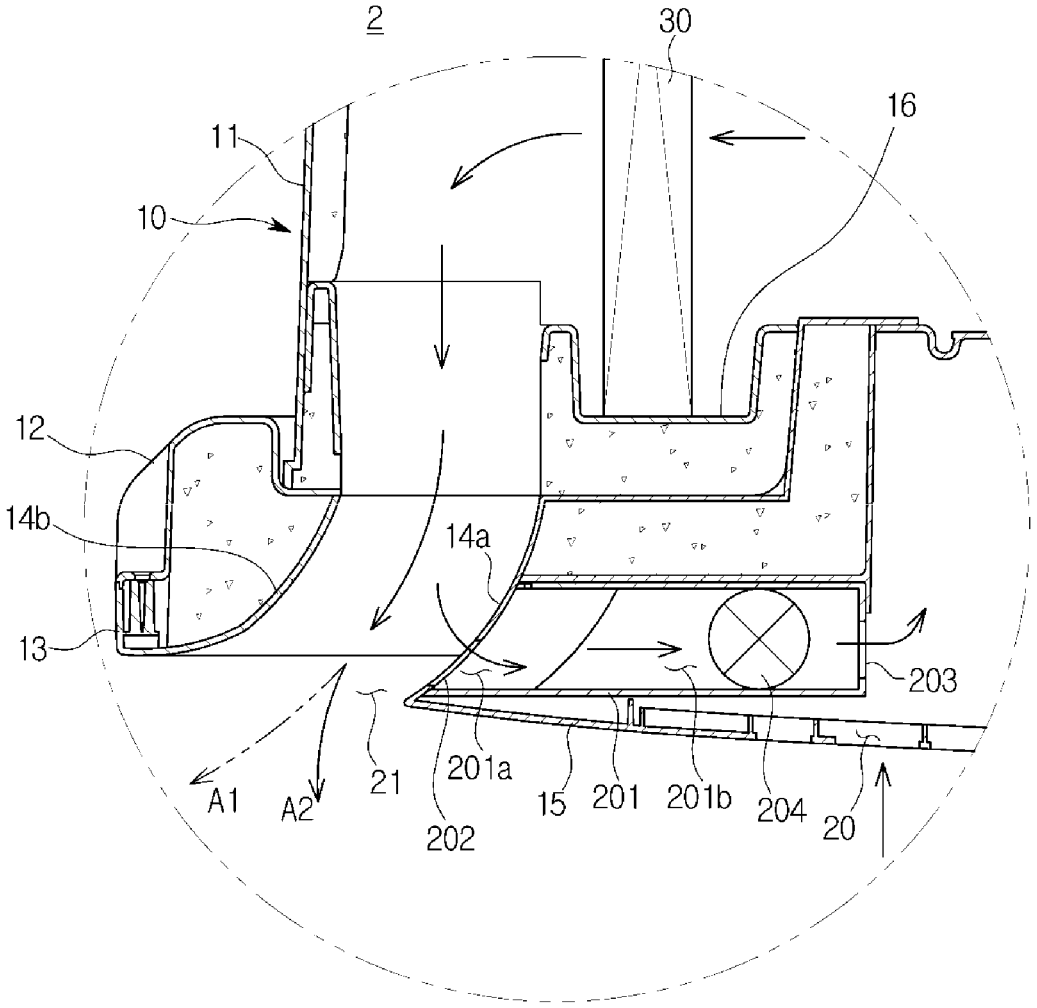

【Fig. 7】
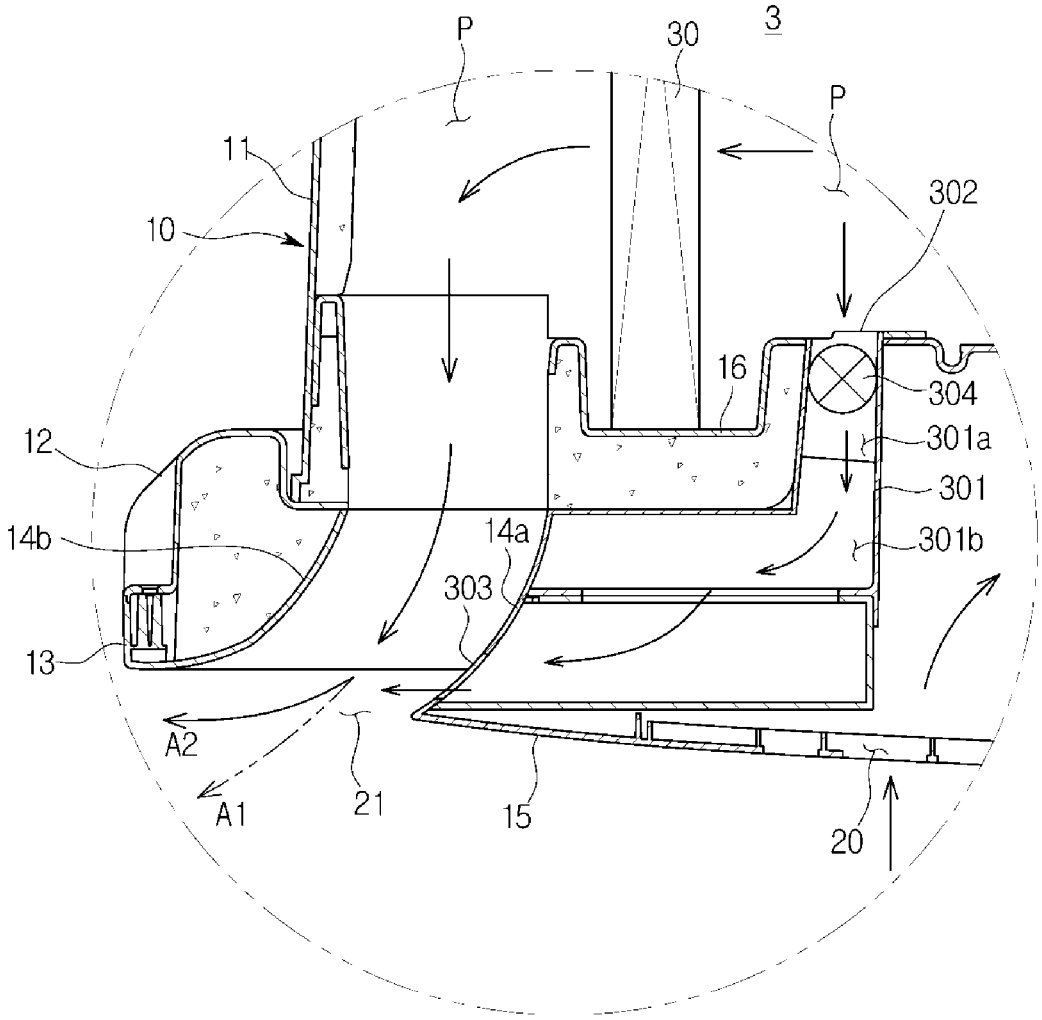

【Fig. 8】
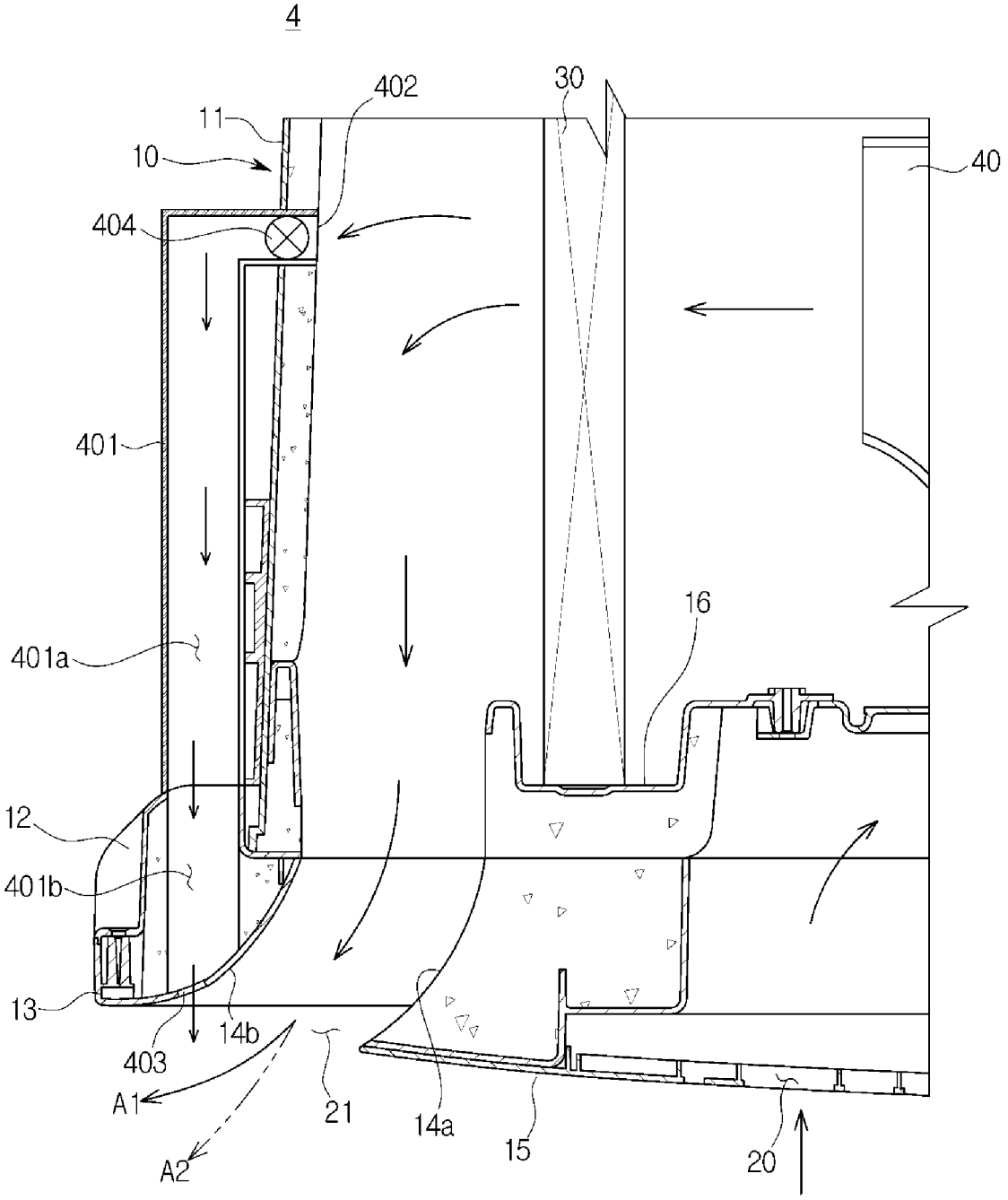

【Fig. 9】
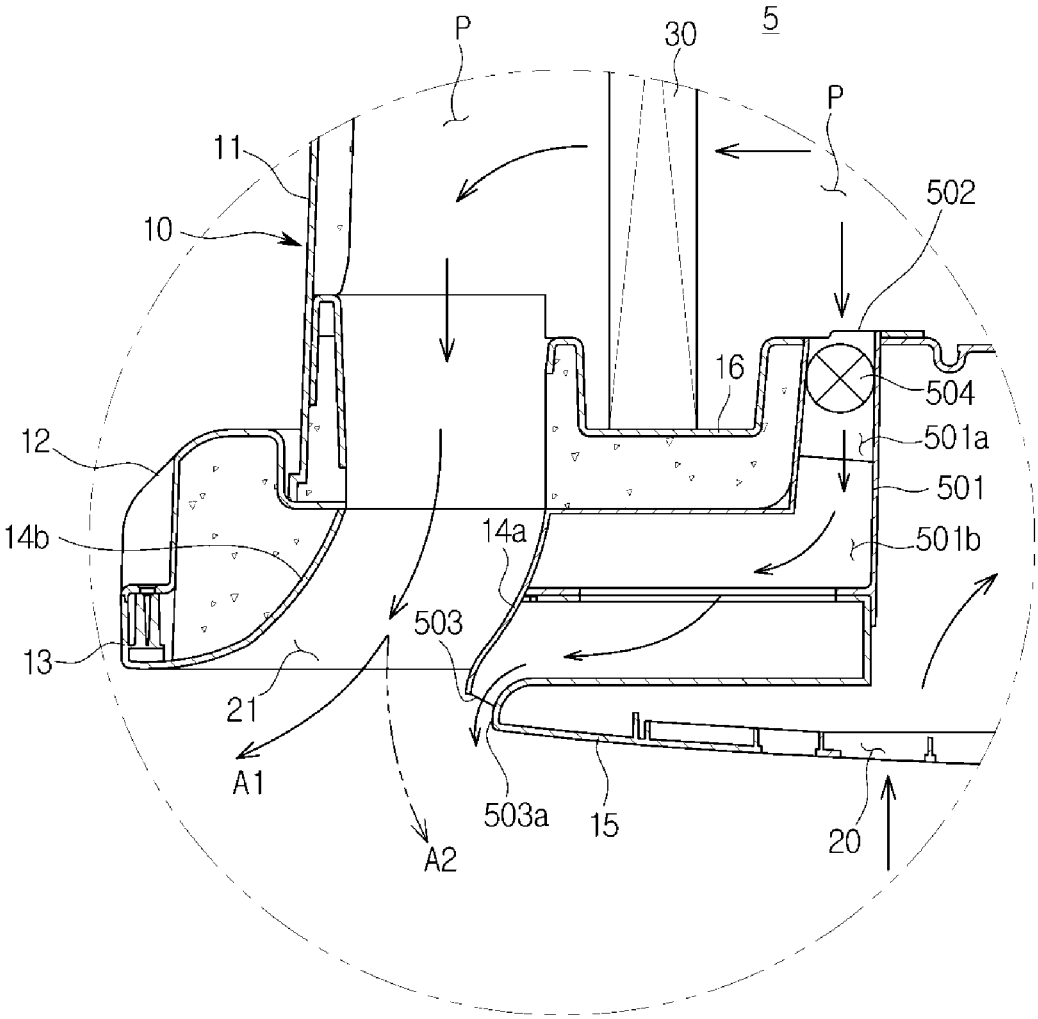

【Fig. 10】
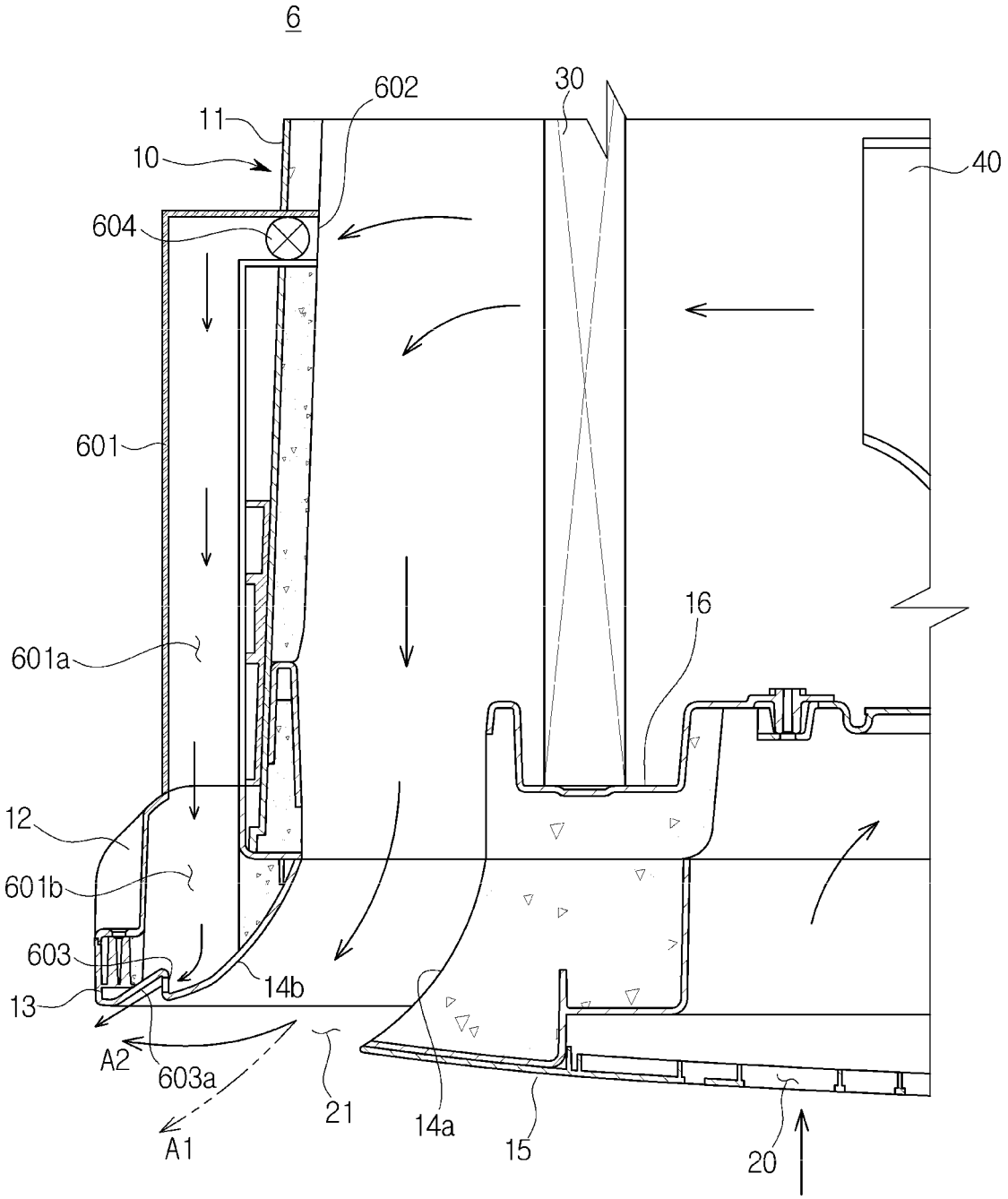

【Fig. 11】
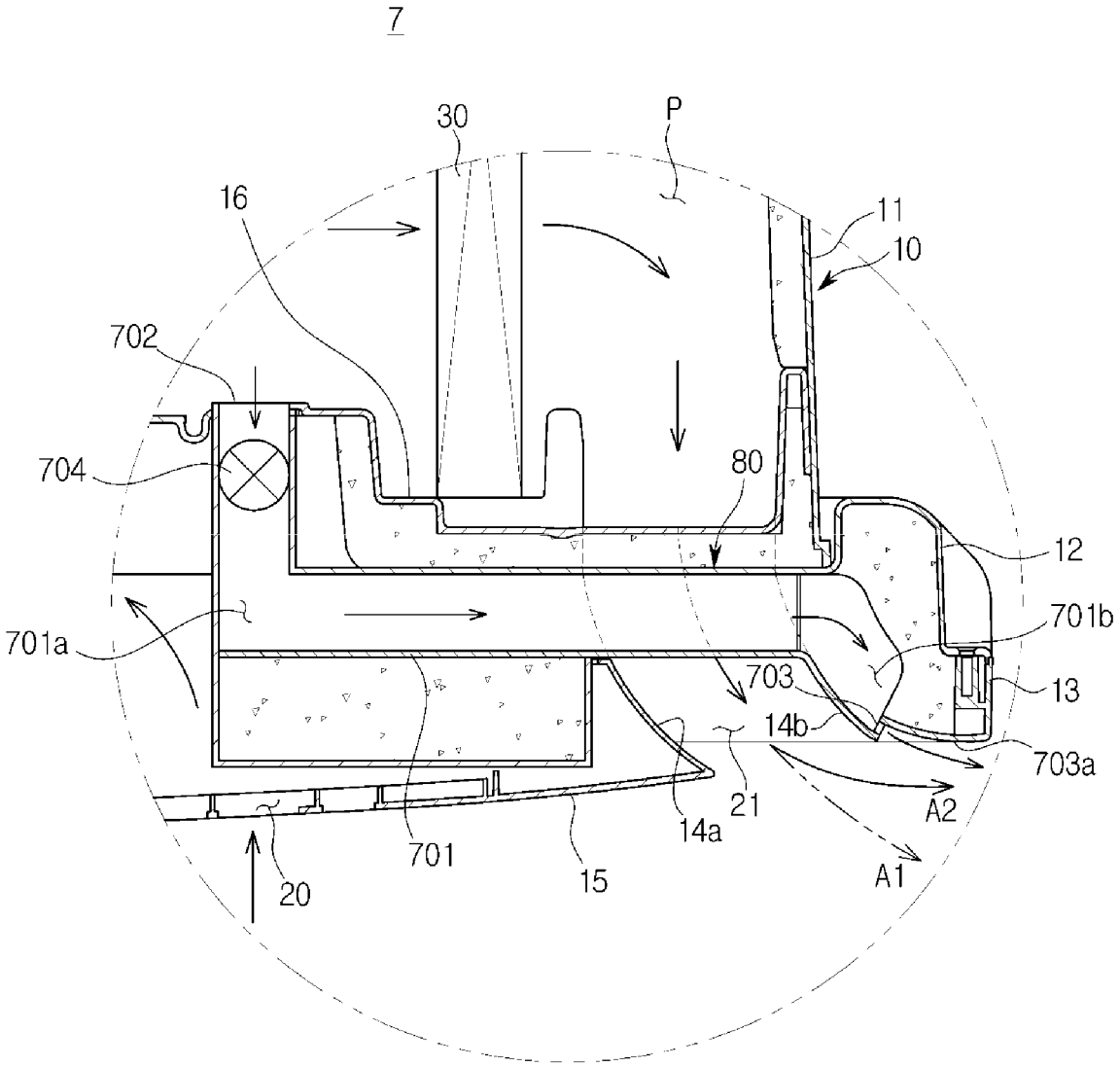

AIR CONDITIONER

CROSS-REFERENCE TO RELATED APPLICATIONS

This application is a U.S. National Stage Application, which claims the benefit under 35 U.S.C. § 371 of PCT International Patent Application No. PCT/KR2016/009246, filed Aug. 22, 2016 which claims the foreign priority benefit under 35 U.S.C. § 119 of Korean Patent Application Nos. 10-2015-0152349 and 10-2015-0160746, filed Oct. 30, 2015 and Nov. 16, 2015, respectively, the contents of which are incorporated herein by reference.

TECHNICAL FIELD

The present invention relates to an air conditioner, and more particularly, to an air conditioner including a circular discharge port.

BACKGROUND ART

An air conditioner includes a compressor, a condenser, an expansion valve, an evaporator, and a blower fan, and is an apparatus for adjusting a temperature, humidity, airflow and the like of a room using a refrigeration cycle. Air conditioners may be classified into a separate type air conditioner that includes an indoor unit disposed in an indoor space and an outdoor unit disposed in an outdoor space and an all-in-one type air conditioner in which both an indoor unit and an outdoor unit are disposed in a single housing.

An air conditioner includes a heat exchanger for exchanging heat between a refrigerant and air, a blower fan for flowing air, and a motor for driving the blower fan, and cools or heats indoor air.

The air conditioner may include a discharged airflow controller for discharging air cooled or heated through the heat exchanger in various directions. Generally, the discharged airflow controller includes a vertical or horizontal blade provided at a discharge port and a driver for rotating and driving the blade. That is, an indoor unit of the air conditioner controls a direction of a discharged airflow by adjusting a rotation angle of the blade.

According to a discharged airflow control structure using such a blade, an amount of discharged air may decrease due to the airflow interrupted by the blade, and the turbulence generated around the blade may increase flow noise.

DISCLOSURE

Technical Problem

An aspect of the present invention is directed to providing an air conditioner capable of controlling discharged airflow without a blade structure.

Technical Solution

In accordance with an aspect of an exemplary embodiment, there is provided an air conditioner including a housing including a suction port and a discharge port, a heat exchanger provided inside the housing, a blower fan configured to suction air through the suction port, pass and heat-exchange the air through the heat exchanger, and then discharge the air through the discharge port, and a sub-flow path that suctions and guides some air around the discharge port using a suction force of the blower fan to control the flowing direction of the air discharged from the discharge port.

The sub-flow path may include an inlet port configured to suction some of the air around the discharge port and an outlet port configured to discharge the air suctioned through the inlet port to an inside of the housing.

The air conditioner may further include an opening/closing control device provided on the sub-flow path and configured to adjust an opening degree of the sub-flow path.

The inlet port may be provided at a radially outer side of the discharge port on the discharge port.

As the opening/closing control device opens the sub-flow path, a discharge direction of the air discharged through the discharge port may be changed toward the radially outer side of the discharge port.

The outlet port may be provided in an upper portion of the housing, which is adjacent to the blower fan.

The inlet port may be provided at a radially inner side of the discharge port on the discharge port As the opening/closing control device opens the sub-flow path, a discharge direction of the air discharged through the discharge port may be changed toward the radially inner side of the discharge port.

The outlet port may be provided to communicate with the suction port.

The blower fan may suction air from both sides thereof in a direction of rotation axis of the blower fan and discharge the air in a radial direction of the blower fan.

The blower fan may be configured such that one side of the blower fan in a direction of rotation axis of the blower fan faces the suction port and the other side opposite to the one side faces the outlet port.

In accordance with an aspect of another exemplary embodiment, there is provided an air conditioner including a housing including a main flow path that connects a suction port and a discharge port, a heat exchanger provided on the main flow path, a blower fan configured to suction air through the suction port, pass and heat-exchange the air through the heat exchanger, and then discharge the air through the discharge port, and a sub-flow path branched off from the main flow path, wherein some air blown by the blower fan is discharged through the sub-flow path toward the discharge port in a different direction from a direction of air discharged through the main flow path.

The air conditioner may further include an opening/closing control device provided on the sub-flow path and configured to adjust an opening degree of the sub-flow path.

The sub-flow path may be provided such that some of the air blown by the blower fan is branched off from the main flow path before passing through the heat exchanger.

The sub-flow path may discharge some of the air blown by the blower fan in a radially inner side of the discharge port.

As the opening/closing control device opens the sub-flow path, a discharge direction of the air discharged through the discharge port may be changed toward the radially outer side of the discharge port.

The sub-flow path may discharge air from a radially outer side of the discharge port.

As the opening/closing control device opens the sub-flow path, a discharge direction of the air discharged through the discharge port may be changed toward the radially inner side of the discharge port.

In accordance with an aspect of still another exemplary embodiment, there is provided an air conditioner including a housing including a main flow path that connects a suction port and a discharge port, a heat exchanger provided on the main flow path, a blower fan provided on the main flow path to flow air, a sub-flow path provided separately from the main flow path, one end of the sub-flow path adjacent to the discharge port, and the other end adjacent to the blowing fan, an opening/closing control device provided on the sub-flow path and configured to adjust an opening degree of the sub-flow path.

The other end of the sub-flow path is adjacent to a portion of the blower fan where air is sucked, when the opening/closing control device opens the sub-flow path, a part of the air around the discharge port may be sucked into the sub-flow path by a suction force of the blower fan, and the discharge direction of the air discharged from discharge port may be changed.

The other end of the sub-flow path is adjacent to a portion of the blower fan where air is discharged, when the opening/closing control device opens the sub-flow path, a part of the air blown by the blower fan may be discharged toward the discharge port through the sub-flow path, and discharge direction of the air discharged from the discharge port may be changed by the air discharged through the sub-flow path.

In accordance with an aspect of still another exemplary embodiment, there is provided an air conditioner including a housing including a main flow path that connects a suction port and a discharge port, a heat exchanger provided on the main flow path, a blower fan configured to suction air through the suction port, pass and heat-exchange the air through the heat exchanger, and then discharge the air through the discharge port, and a sub-flow path branched off from the main flow path, wherein the sub-flow path is configured to switch the discharge direction of the air discharged from the discharge port to the air discharged through the sub-flow path.

The air conditioner may further include an opening/closing control device provided on the sub-flow path and configured to adjust an opening degree of the sub-flow path.

The sub-flow path may discharge air in a direction different from the direction of the air discharged from the discharge port.

The sub-flow path may be configured to discharge air inside the radial direction of the discharge port, the air discharged through the sub-flow path may switch the discharge direction of the air discharged from the discharge port toward the radially inner side of the discharge port.

The sub-flow path may be configured to discharge air outside the radial direction of the discharge port, the air discharged through the sub-flow path may switch the discharge direction of the air discharged from the discharge port toward the radially outer side of the discharge port.

Advantageous Effects

According to the spirit of the present invention, an air conditioner can suction air around a discharge port without a blade to control discharged airflow.

According to the spirit of the present invention, an air conditioner can control discharged airflow with a relatively simple structure to reduce a product cost.

According to the spirit of the present invention, an air conditioner can decrease a reduction of an amount of discharged airflow due to an interruption by a blade because the air conditioner controls the discharged airflow without the blade.

According to the spirit of the present invention, an air conditioner can reduce flow noise because the air conditioner controls discharged airflow without a blade.

DESCRIPTION OF DRAWINGS

FIG. 1 illustrates a perspective view of an air conditioner according to an exemplary embodiment of the present invention.

FIG. 2 illustrates a bottom view of the air conditioner shown in FIG. 1.

FIG. 3 illustrates a cross-sectional view of the air conditioner according to the exemplary embodiment of the present invention, which is taken along line I-I of FIG. 2.

FIG. 4 illustrates an expanded view of portion O shown in FIG. 3.

FIG. 5 illustrates a block diagram of a control system of the air conditioner shown in FIG. 1.

FIG. 6 illustrates a cross-sectional view of an air conditioner according to another exemplary embodiment of the present invention.

FIG. 7 illustrates a cross-sectional view of an air conditioner according to still another exemplary embodiment of the present invention.

FIG. 8 illustrates a cross-sectional view of an air conditioner according to yet another exemplary embodiment of the present invention.

FIG. 9 illustrates a cross-sectional view of an air conditioner according to yet another exemplary embodiment of the present invention.

FIG. 10 illustrates a cross-sectional view of an air conditioner according to yet another exemplary embodiment of the present invention.

FIG. 11 illustrates a cross-sectional view of an air conditioner according to yet another exemplary embodiment of the present invention.

MODES OF THE INVENTION

Exemplary embodiments described in the specification and configurations shown in the drawings are merely examples of preferred embodiments of the present invention, and various modifications may exist at the time of filing of the present application to replace the exemplary embodiments and drawings of the specification.

In addition, the same reference numerals or symbols given in the drawings of the specification indicate parts or elements that perform substantially a same function.

Also, terms used in the specification are used to illustrate the exemplary embodiments and are not intended to limit and/or define the disclosed invention. Singular forms include plural referents unless the context clearly dictates otherwise. In this specification, the terms "comprises" or "having" and the like are used to specify that there is a stated feature, number, step, operation, element, part, or a combination thereof but do not preclude the presence or addition of one or more features, integers, steps, operations, elements, parts, or combinations thereof.

It is also to be understood that terms including ordinals such as "first," "second," and the like used in the specification may be used to describe various elements, but the elements are not limited by the terms and the terms are used only to distinguish an element from another. For instance, a first element may be referred to as a second element without departing from the scope of the present invention, and similarly, a second element may be referred to as a first element. The term "and/or" includes any combination of a plurality of related listed items and any of a plurality of related listed items.

Meanwhile, the terms "front end," "rear end," "upper portion," "lower portion," "upper end," and "lower end" used in the following description are defined with reference to the drawings, but do not limit a shape and location of each element.

Hereinafter, exemplary embodiments of the present invention will be described in detail with reference to the appended drawings.

FIG. 1 illustrates a perspective view of an air conditioner according to an exemplary embodiment of the present invention. FIG. 2 illustrates a bottom view of the air conditioner shown in FIG. 1. FIG. 3 illustrates a cross-sectional view of the air conditioner according to the exemplary embodiment of the present invention, which is taken along line I-I of FIG. 2. FIG. 4 illustrates an expanded view of portion O shown in FIG. 3. FIG. 5 illustrates a block diagram of a control system of the air conditioner shown in FIG. 1.

An air conditioner 1 according to the exemplary embodiment of the present invention will be described with reference to FIGS. 1 to 5.

The air conditioner 1 may be installed on a ceiling C. A part of the air conditioner 1 may be buried in the ceiling C.

The air conditioner 1 may include a housing 10 including a suction port 20 and a discharge port 21, a heat exchanger 30 provided within the housing 10, and a blower fan 40 configured to flow air.

The housing 10 may have an approximately circular shape when viewed from above. The housing 10 may include an upper housing 11 disposed within the ceiling C, an intermediate housing 12 coupled to a lower portion of the upper housing 11, and a lower housing 13 coupled to a lower portion of the intermediate housing 12.

The suction port 20 through which air is suctioned may be formed in a central portion of the lower housing 13, and the discharge port 21 through which air is discharged may be formed on a radially outer side of the suction port 20. The discharge port 21 may have an approximately circular shape when viewed from above.

With such a structure, the air conditioner 1 may suction air from a lower portion thereof, cool and heat the air, and discharge the air back to the lower portion.

The lower housing 13 may include a first guide surface 14*a* and a second guide surface 14*b* forming the discharge port 21. The first guide surface 14*a* may be provided adjacent to the suction port 20, and the second guide surface 14*b* may be provided more spaced apart from the suction port 20 than the first guide surface 14*a*. In other words, the first guide surface 14*a* may be provided at a radially inner side of the discharge port 21, and the second guide surface 14*b* may be provided on a radially outer side of the discharge port 21. The first guide surface 14*a* and/or the second guide surface 14*b* may include a Coanda curved surface portion that guides air discharged through the discharge port 21. The Coanda curved surface portion may induce airflow discharged through the discharge port 21 to flow in a close contact with the Coanda curved surface portion.

A grille 15 may be coupled to a lower surface of the lower housing 13 to filter dust from air suctioned into the suction port 20.

The heat exchanger 30 may be provided inside the housing 10 and disposed on a flow path of air between the suction port 20 and the discharge port 21. The heat exchanger 30 may include a tube (not shown) through which a refrigerant flows and a header (not shown) connected to an external refrigerant tube to supply the refrigerant to the tube or retrieve the refrigerant from the tube. A heat exchange fin (not shown) may be provided on the tube to increase a heat dissipation area.

The heat exchanger 30 may have an approximately circular shape when viewed from above. The heat exchanger 30 is disposed on a drain tray 16 so that condensate water generated in the heat exchanger 30 may be collected in the drain tray 16.

The blower fan 40 may be provided on a radially inner side of the heat exchanger 30. The blower fan 40 may be a centrifugal fan that suctions air in an axial direction thereof and discharges the air in a radial direction thereof. Further, the blower fan 40 may be provided with a rotation center at an approximately central portion in the axial direction so that air can be suctioned from both sides in the axial direction. A blowing motor 41 for driving the blower fan 40 may be provided at the air conditioner 1.

With such a configuration, the air conditioner 1 may suction and cool air in a room and then discharge the air to the room, or may suction and heat the air in the room and then discharge the air to the room.

The air conditioner 1 may further include a heat exchanger pipe 81 connected to the heat exchanger 30, through which the refrigerant flows, and a drain pump 82 for discharging condensed water collected in the drain tray 16 to the outside. The heat exchanger pipe 81 and the drain pump 82 may be provided on an upper portion of a bridge 80 to be described below so as not to block the suction port. Specifically, the heat exchanger pipe 81 may be seated on a heat exchanger pipe seat portion 16*a* provided in the drain tray 16, and the drain pump 82 may be seated on a drain pump seat portion 16*b*.

Referring to FIG. 2, the air conditioner 1 may be provided adjacent to the discharge port 21 and further include the bridge 80 extending in a circumferential direction of the discharge port 21 by a predetermined length. Three bridges 80 may be provided to be spaced a predetermined interval from each other in the circumferential direction. The bridge 80 may be provided to connect the first guide surface 14*a* with the second guide surface 14*b*.

When the discharge port 21 is provided in a circular shape and air is discharged in all directions, a relatively high pressure is formed around the discharge port 21 and a relatively low pressure is formed around the suction port 20. In addition, since air is discharged in all directions of the discharge port 21 and forms an air curtain, air to be suctioned through the suction port 20 cannot be supplied toward the suction port 20. In this situation, the air discharged from the discharge port 21 is suctioned through the suction port 20 again, the re-suctioned air causes dew condensation inside the housing 10, and the air to be discharged is lost, which degrades a perceived performance.

The bridge 80 according to the exemplary embodiment of the present invention is provided over the discharge port 21 and blocks the discharge port 21 by a predetermined length. Accordingly, the discharge port 21 is divided into a first section S1 in which air is discharged and a second section S2 in which air is hardly discharged because the air is blocked by the bridge 80. That is, the bridge 80 may form the second section S2 through which air to be suctioned through the suction port 20 is supplied. Further, the bridge 80 may reduce a pressure difference between a low pressure around the suction port 20 and a high pressure around the discharge port 21 so that the air can be smoothly supplied to the suction port 20.

The bridge 80 may include a pair of discharge guide surfaces 80*a* getting closer to each other as the discharge guide surfaces 80*a* get closer to a direction in which air is discharged so as to minimize the second section S2 formed by the bridge 80. The air discharged from the discharge port 21 by the discharge guide surfaces 80*a* may be more widely spread and discharged from the discharge port 21.

The air conditioner 1 shown in FIG. 2 has three bridges 80 arranged at equal intervals, that is, at an angle of 120°, but the air conditioner 1 is not limited thereto and may have one bridge, two bridges arranged at an angle of 180°, or more than four bridges arranged to be spaced apart from each other in the circumferential direction of the discharge port 21. That is, the number of bridges and the angle at which the bridges are disposed are not limited.

Further, when a plurality of bridges 80 are provided, a display unit 85 may be disposed under one bridge 80 of the plurality of bridges 80. The display unit 85 may display an operating state of the air conditioner 1 to a user. Specifically, the display unit 85 may display whether the air conditioner 1 is operating, a direction of discharged airflow, or whether the air conditioner 1 is operating in a cooling mode or in a heating mode, but is not limited thereto and various information related to the air conditioner 1 may be displayed. In addition to the display unit 85, although not shown in the drawings, at least one of a remote control receiver unit (not shown), an input unit (not shown) of the air conditioner 1, and a communication unit (not shown) configured to communicate with an external device may be provided under the bridge 80.

The air discharged through the discharge port 21 may be spread and discharged to cool or heat the room by the bridge 80 without being suctioned into the suction port 20 again.

The air conditioner 1 may further include a sub-flow path 101 that suctions some of the air around the discharge port 21 to control the discharged airflow. Here, the control of the discharged airflow means to control a direction of the discharged airflow, that is, the discharge angle of the air discharged through the discharge port 21.

The sub-flow path 101 may be provided around the discharge port 21 and connect an inlet port 102 through which some of the air around the discharge port 21 flows and an outlet port 103 through which the air flowing in the inlet port 102 is discharged to an inside of the housing 10. The sub-flow path 101 may be provided along an outer surface of the upper housing 11 on an outer side of the upper housing 11. Alternatively, the sub-flow path 101 may be provided within the housing 10.

The sub-flow path 101 may include a first flow path 101*a*, which is formed outside the housing 10 and in a circumferential direction of the housing 10 and communicates with the inlet port 102, and a second flow path 101*b* extending from the first flow path 101*a* to an upper surface of the housing 10. Air suctioned through the inlet port 102 may be discharged to the inside of the housing 10 through the outlet port 103 via the first flow path 101*a* and second flow path 101*b*. However, the above structure of the sub-flow path 101 is merely given as an example, the sub-flow path 101 is sufficient only to connect the inlet port 102 and the outlet port 103, and the structure, shape, and arrangement thereof are not limited.

The inlet port 102 may be formed in the second guide surface 14*b* provided at the radially outer side of the discharge port 21. The outlet port 103 may be formed in an upper surface of the upper housing 11. Specifically, the outlet port 103 may be formed above the blower fan 40. The outlet port 103 may be formed in the upper surface of the upper housing 11 adjacent to the rotation center of the blower fan 40. In this case, the blower fan 40 may be configured to suction air from both the lower side at which the suction port 20 is provided and the upper side at which the outlet port 103 is provided and to discharge the air in a radial direction of the blower fan 40, as described above.

According to such a configuration, some of the air around the discharge port 21 may be suctioned through the inlet port 102 by suction force of the blower fan 40, pass through the sub-flow path 101, and then be discharged through the outlet port 103. A flow direction of the air discharged from the discharge port 21 may be changed as some of the air around the discharge port 21 is suctioned into the sub-flow path 101 through the inlet port 102. In this case, the suction force of the blower fan 40 may be adjusted by adjusting a rotational speed of the blower fan 40, and an amount of air that can be suctioned through the inlet port 102 may be adjusted accordingly. In addition, as the amount of the air suctioned through the inlet port 102 is adjusted, the flow direction of the air discharged from the discharge port 21 may also be gradually changed.

An opening/closing control device 104 capable of adjusting an opening degree of the sub-flow path 101 may be provided on the sub-flow path 101.

The opening/closing control device 104 may be a switch capable of selectively opening the sub-flow path 101. The opening/closing control device 104 may be a damper. The opening/closing control device 104 may be disposed adjacent to the blower fan 40 on the sub-flow path 101. The opening/closing control device 104 may allow the air around the discharge port 21 to be selectively suctioned through the inlet port 102 by selectively opening the sub-flow path 101.

Specifically, referring to FIG. 4, when the opening/closing control device 104 does not open the sub-flow path 101, a suction force of the blower fan 40 is not delivered to the inlet port 102. Accordingly, the air around the discharge port 21 is not suctioned into the inlet port 102, and discharged airflow is formed in a direction A1. Conversely, when the opening/closing control device 104 opens the sub-flow path 101, the suction force of the blower fan 40 is delivered to the inlet port 102. Thus, the air around the discharge port 21 is suctioned into the inlet port 102, and the discharged airflow is formed in a direction A2. In other words, since a flow direction of the discharged airflow is changed to the radially outer side of the discharge port 21 so that the discharged airflow may be widely spread.

In addition, the opening/closing control device 104 may adjust an amount of the air around the discharge port 21 that is suctioned through the inlet port 102 by adjusting the opening degree of the sub-flow path 101. Further, as the amount of the air around the discharge port 21 that is suctioned through the inlet port 102 is adjusted, a degree of direction change of the air discharged from the discharge port 21 may be adjusted.

Specifically, referring to FIG. 5, when a user inputs a command to a control unit 91 to fully open the opening/closing control device 104 through an input unit 90, the control unit 91 may control the opening/closing control device 104 to fully open the sub-flow path 101 and the air discharged through the discharge port 21 accordingly spreads as much as possible toward the radially outer side of the discharge port 21. That is, the discharged airflow may be formed in the direction A2.

In contrast, when the user inputs a command to the control unit 91 to partially open the opening/closing control device 104 through the input unit 90, the control unit 91 controls the opening/closing control device 104 to open only a part of the sub-flow path 101, and the air discharged through the discharge port 21 accordingly less spreads toward the radially outer side of the discharge port 21 than in the direction A2. That is, the discharged airflow may be formed in a direction between the direction A2 and the direction A1.

It is apparent to a person of ordinary skill in the art that the discharged airflow may be formed in any direction by more finely controlling an opening degree of the opening/closing control device 104.

With such a configuration, the air conditioner 1 according to the exemplary embodiment of the present invention may control the discharged airflow without a blade structure, as compared with the conventional structure in which a blade is provided in the discharge port 21 and the discharged airflow is controlled by the rotation of the blade. Accordingly, since there is no interruption by the blade, the discharge amount can be increased and the flow noise can be reduced.

FIG. 6 illustrates a cross-sectional view of an air conditioner 2 according to another exemplary embodiment of the present invention. The air conditioner 2 according to another exemplary embodiment of the present invention will be described with reference to FIG. 6. However, the same reference symbols will be assigned to the same components as those in the exemplary embodiment shown in FIG. 4, and the description thereof will be omitted.

A sub-flow path 201 of the air conditioner 2 may be provided in the lower housing 13. Specifically, an inlet port 202 may be formed in the first guide surface 14*a* provided at the radially inner side of the discharge port 21. An outlet port 203 may be provided in the suction port 20 to communicate with the suction port 20. As the outlet port 203 communicates with the suction port 20, suction force generated at the suction port 20 of the blower fan 40 may be delivered to the sub-flow path 201 such that the inlet port 202 may suction air around the discharge port 21.

The sub-flow path 201 is formed to connect the inlet port 202 and the outlet port 203. The sub-flow path 201 may include a first flow path 201*a*, which extends in a circumferential direction thereof and communicates with the inlet port 202, and a second flow path 201*b* extending from the first flow path 201*a* toward the radially inner side of the discharge port 21. Accordingly, the air suctioned through the inlet port 202 may pass through the first flow path 201*a* and the second flow path 201*b* and be discharged through the outlet port 203. However, such a structure of the sub-flow path 201 is merely given as an example, the sub-flow path 201 is sufficient only to connect the inlet port 202 and the outlet port 203, and the structure, shape, and arrangement thereof are not limited.

In addition, the sub-flow path 201 may extend by a predetermined length in the circumferential direction of the discharge port 21. The sub-flow path 201 may be provided to be spaced apart from each other in the circumferential direction of the discharge port 21 and be provided in plural.

According to such a configuration, the air conditioner 2 may suction the air around the discharge port 21 through the inlet port 202 formed in the first guide surface 14*a* using the suction force of the blower fan 40, and discharge the air to the inside of the housing 10 through the outlet port 203 formed at the side of the suction port 20.

Specifically, when an opening/closing control device 204 does not open the sub-flow path 201, the suction force of the blower fan 40 is not delivered to the inlet port 202. Therefore, the air around the discharge port 21 is not suctioned into the inlet port 202, and the air discharged through the discharge port 21 is discharged in the direction A1. On the other hand, when the opening/closing control device 204 opens the sub-flow path 201, the suction force of the blower fan 40 is delivered to the inlet port 202. Thus, some of the air around the discharge port 21 is suctioned into the sub-flow path 201 through the inlet port 202, and the air discharged through the discharge port 21 is discharged in the direction A2. In other words, the direction of the discharged airflow is changed to the radially inner side of the discharge port 21.

In addition, as shown in FIG. 4, the opening/closing control device 204 may adjust the amount of the air around the discharge port 21, which is suctioned through the inlet port 202, by adjusting an opening degree of the sub-flow path 201. As the amount of the air around the discharge port 21 suctioned through the inlet port 202 is adjusted, the degree of direction change of air discharged through the discharge port 21 may be adjusted.

Specifically, when the opening/closing control device 204 fully opens the sub-flow path 201, the discharged airflow may be collected as much as possible toward the radially inner side of the discharge port 21 since the amount of the air around the discharge port 21 suctioned through the inlet port 202 is maximized. That is, the discharged airflow may be formed in the direction A2.

Conversely, when the opening/closing control device 204 partially opens the sub-flow path 201, the discharged airflow is less collected toward the radially inner side of the discharge port 21 than in the direction A2 since the amount of the air around the discharge port 21 suctioned through the inlet port 202 is small. That is, the discharged airflow may be formed in a direction between the direction A1 and the direction A2.

It is apparent to a person of ordinary skill in the art that the discharged airflow can be formed in any direction by more finely controlling an opening degree of the opening/closing control device 204.

FIG. 7 illustrates a cross-sectional view of an air conditioner 3 according to still another exemplary embodiment of the present invention. The air conditioner 3 according to still another exemplary embodiment of the present invention will be described with reference to FIG. 7. However, the same reference symbols will be assigned to the same components as those in the exemplary embodiments described above, and the description thereof will be omitted.

The air conditioner 3 may control the discharged airflow by bypassing some of the air blown by the blower fan 40 to a sub-flow path 301 and then discharging the air in a direction different from that of the air discharged through from the discharge port 21. For this purpose, the air conditioner 3 includes the sub-flow path 301 branched from a main flow path P. The sub-flow path 301 may be provided such that the air blown from the blower fan 40 is branched off from the main flow path P before passing through the heat exchanger 30.

The sub-flow path 301 may connect an inlet port 302 through which some air flowing in the main flow path P flows and an outlet port 303 through which the air introduced through the inlet port 302 is discharged. The sub-flow path 301 may be formed by the intermediate housing 12 and the lower housing 13. The sub-flow path 301 may be provided at the radially inner side of the discharge port 21. The sub-flow path 301 may include a first flow path 301*a* communicating with the inlet port 302 and a second flow path 301*b* that connects the first flow path 301*a* with the outlet port 303 and extends in a circumferential direction thereof. Accordingly, the air introduced through the inlet port 302 may pass through the first flow path 301*a* and the second flow path 301*b* and be discharged through the outlet port 303. Specifically, the air passing through the first flow path 301*a* flows into the entire second flow path 301*b* extending in the circumferential direction, and then is discharged through the outlet port 303. However, the structure of the sub-flow path 301 is given as only an example, the sub-flow path 301 is sufficient only to connect the inlet port 302 and the outlet port 303, and the structure, shape, and arrangement of the sub-flow path 301 are not limited.

The inlet port 302 may be provided on the main flow path P between the blower fan 40 and the heat exchanger 30. Accordingly, some of the air blown by the blower fan 40 may be introduced into the sub-flow path 301 through the inlet port 302. The inlet port 302 may be provided in the drain tray 16.

The outlet port 303 may be formed in the first guide surface 14*a* provided at the radially inner side of the discharge port 21. The outlet port 303 discharges air in a direction different from the flow direction of the air discharged through the discharge port 21. Specifically, the flow direction of the air discharged through the outlet port 303 after passing through the sub-flow path 301 may be formed further toward the radially outer side of the discharge port 21 than the flow direction of the air discharged through the discharge port 21 after passing through the main flow path P. According to such a configuration, the air that is discharged through the outlet port 303 after passing through the sub-flow path 301 may push the air, which is discharged through the discharge port 21 after passing through the main flow path P, toward the radially outer side of the discharge port 21.

An opening/closing control device 304 configured to adjust an opening degree of the sub-flow path 301 may be provided on the sub-flow path 301 adjacent to the inlet port 302.

With such a configuration, the air conditioner 3 may change the discharge direction of the air discharged through the discharge port 21.

Specifically, when the opening/closing control device 304 does not open the sub-flow path 301, all of the air blown by the blower fan 40 passes through the heat exchanger 30 and is then discharged from the main flow path P and the discharge port 21 in the direction A1.

Conversely, when the opening/closing control device 304 opens the sub-flow path 301, some of the air blown by the blower fan 40 is branched off from an upstream of the main flow path P into the sub-flow path 301 before passing through the heat exchanger 30. The air introduced into the sub-flow path 301 pushes the air, which is discharged through the discharge port 21 through the outlet port 303, toward the radially outer side of the discharge port 21 and is discharged. In other words, the flow direction of the air discharged through the discharge port 21 is changed to the direction A2. Accordingly, the discharged airflow may be spread widely.

In addition, as in the above-described exemplary embodiments, the opening/closing control device 304 may adjust an amount of the air, which is discharged through the outlet port 303 after passing through the sub-flow path 301, by adjusting the opening degree of the sub-flow path 301. Further, the degree of flow direction change of the air discharged through the discharge port 21 may be adjusted by adjusting the amount of the air discharged through the outlet port 303.

Specifically, when the opening/closing control device 304 fully opens the sub-flow path 301, the amount of the air discharged through the outlet port 303 through the sub-flow path 301 is maximized, and the air discharged through the discharge port 21 is accordingly spread as much as possible toward the radially outer side of the discharge port 21. That is, the discharged airflow may be formed in the direction A2.

On the other hand, when the opening/closing control device 304 partially opens the sub-flow path 301, the amount of the air discharged through the outlet port 303 through the sub-flow path 301 is small and the air discharged through the discharge port 21 is accordingly less spread toward the radially outer side of the discharge port 21 than in the direction A2. That is, the discharged airflow may be formed in a direction between the direction A1 and the direction A2.

It is apparent to a person of ordinary skill in the art that the discharged airflow can be formed in any direction by more finely controlling an opening degree of the opening/closing control device 304.

FIG. 8 illustrates a cross-sectional view of an air conditioner 4 according to yet another exemplary embodiment of the present invention. The air conditioner 4 according to yet another exemplary embodiment of the present invention will be described with reference to FIG. 8. However, the same reference symbols will be assigned to the same components as those in the exemplary embodiments described above, and the description thereof will be omitted.

The air conditioner 4 may control the discharged airflow by bypassing some of the air blown by the blower fan 40 to a sub-flow path 401 and then discharging the air in a direction different from that of the air discharged through the discharge port 21. In this case, the sub-flow path 401 may be provided such that the air blown by the blower fan 40 is branched off from the main flow path P after passing through the heat exchanger 30.

The sub-flow path 401 may connect an inlet port 402 and an outlet port 403. The sub-flow path 401 may be formed along an outer wall of the housing 10 using a separate duct, or formed inside the housing 10.

The sub-flow path 401 may include a first flow path 401*a* communicating with the inlet port 402 and a second flow path 401*b* that connects the first flow path 401*a* and the outlet port 403 and extends in a circumferential direction thereof. Accordingly, the air introduced through the inlet port 402 may pass through the first flow path 401*a* and second flow path 401*b* and then be discharged through the outlet port 403. Specifically, the air passing through the first flow path 401*a* flows through the entire second flow path 401*b* extending in the circumferential direction and then discharged through the outlet port 403. However, such a structure of the sub-flow path 401 is given as only an example, the sub-flow path 401 is sufficient only to connect the inlet port 402 and the outlet port 403, and the structure, shape, and arrangement thereof are not limited.

The inlet port 402 may be provided on the main flow path P between the heat exchanger 30 and the discharge port 21. Accordingly, some of the air that is blown by the blower fan 40 and passes through the heat exchanger 30 may be introduced into the sub-flow path 401 through the inlet port 402. The inlet port 402 may be provided in the upper housing 11.

The outlet port 403 may be formed in the second guide surface 14*b* provided on the radially outer side of the discharge port 21. The outlet port 403 discharges air in a different direction from the flow direction of the air discharged through the discharge port 21. Specifically, the flow direction of the air discharged through the outlet port 403 after passing through the sub-flow path 401 may be formed further toward the radially inner side of the discharge port 21 than the flow direction of the air discharged through the discharge port 21 after passing through the main flow path P. According to such a configuration, the air discharged through the outlet port 403 after passing through the sub-flow path 401 may push the air, which is discharged through the discharge port 21 after passing through the main flow path P, toward the radially inner side of the discharge port 21.

An opening/closing control device 404 configured to adjust an opening degree of the sub-flow path 401 may be provided on the sub-flow path 401 adjacent to the inlet port 402.

With such a configuration, the air conditioner 4 may change the discharge direction of the air discharged through the discharge port 21.

Specifically, when the opening/closing control device 404 does not open the sub-flow path 401, the air blown by the blower fan 40 passes through the heat exchanger 30 and is then fully discharged through the main flow path P and the discharge port 21 in the direction A1.

On the other hand, when the opening/closing control device 404 opens the sub-flow path 401, some of the air blown by the blower fan 40 passes through the heat exchanger 30 and is then branched off toward the sub-flow path 401. The air introduced into the sub-flow path 401 pushes the air discharged through the discharge port 21 through the outlet port 403 toward the radially inner side of the discharge port 21, and is discharged. That is, the flow direction of the air discharged through the discharge port 21 is changed to the direction A2. Accordingly, the discharged airflow may be formed in an approximately vertical direction.

In addition, as in the above-described exemplary embodiments, the opening/closing control device 404 may adjust an amount of the air, which is discharged through the outlet port 403 after passing through the sub-flow path 401, by adjusting the opening degree of the sub-flow path 401. Further, the degree of flow direction change of the air discharged through the discharge port 21 may be adjusted by adjusting the amount of the air discharged through the outlet port 403.

Specifically, when the opening/closing control device 404 fully opens the sub-flow path 401, the amount of the air passing through the sub-flow path 401 increases. Accordingly, since the air discharged through the outlet port 403 strongly pushes and discharges the air discharged through the discharge port 21 in a vertical direction, the discharged airflow is collected as much as possible toward the radially inner side of the discharge port 21. Conversely, when the opening/closing control device 404 partially opens the sub-flow path 401, the amount of the air passing through the sub-flow path 401 decreases. Accordingly, since the force that the air discharged through the outlet port 403 pushes out the air discharged through the discharge port 21 decreases, the discharged airflow is collected a small amount toward the radially inner side of the discharge port 21. That is, the discharged airflow may be formed in a direction between the direction A1 and the direction A2.

It is apparent to a person of ordinary skill in the art that the discharged airflow can be formed in any direction by more finely controlling an opening degree of the opening/closing control device 404.

FIG. 9 illustrates a cross-sectional view of an air conditioner 5 according to yet another exemplary embodiment of the present invention. The air conditioner 5 according to yet another exemplary embodiment of the present invention will be described with reference to FIG. 9. However, the same reference symbols will be assigned to the same components as those in the exemplary embodiments described above, and the description thereof will be omitted.

The air conditioner 5 may control the discharged airflow by bypassing some of the air blown by the blower fan 40 to a sub-flow path 501 and then discharging the air in a direction different from that of the air discharged through the discharge port 21. On the other hand, the sub-flow path 501 may control the discharged airflow by discharging the air in a direction similar to that of the air discharged through the discharge port 21. For the purpose, the air conditioner 5 includes the sub-flow path 501 branched off from the main flow path P. The sub-flow path 501 may be provided such that the air blown by the blower fan 40 is branched off from the main flow path P before passing through the heat exchanger 30.

The sub-flow path 501 may connect an inlet port 502 through which some of the air flowing through the main flow path P is introduced and an outlet port 503 through which the air introduced through the inlet port 502 is discharged. The sub-flow path 501 may be provided at the radially inner side of the discharge port 21. The sub-flow path 501 may include a first flow path 501*a* communicating with the inlet port 502 and a second flow path 501*b* that connects the first flow path 501*a* and the outlet port 503 and extends in a circumferential direction thereof. However, such a structure of the sub-flow path 501 is given as only an example, the sub-flow path 501 is sufficient only to connect the inlet port 502 and the outlet port 503, and the structure, shape, and arrangement thereof are not limited.

The inlet port 502 may be provided on the main flow path P between the blower fan 40 and the heat exchanger 30. Accordingly, some of the air blown by the blower fan 40 may be introduced into the sub-flow path 501 through the inlet port 502.

The outlet port 503 may be provided to be directed approximately downward from the radially inner side of the discharge port 21. The outlet port 503 may be provided to have a sectional area smaller than that of the discharge port 21. Further, a radially inner surface of the outlet port 503 may include a Coanda curved surface portion 503*a* that guides the air discharged through the outlet port 503 in an approximately downward direction. The first guide surface 14*a* and the Coanda curved surface portion 503*a* may be formed to have a step.

According to such a configuration, the outlet port 503 may convert the flow direction of the air discharged through the discharge port 21. Specifically, the flow direction of the air discharged through the outlet port 503 is further directed to the radially inner side of the discharge port 21 than that of the air discharged through the discharge port 21.

With such a configuration, the air discharged through the outlet port 503 is discharged at a high speed and induces the air discharged from the discharge port 21 to draw the air toward the outlet port 503. In other words, the discharge direction of the air discharged from the discharge port 21 is converted from the direction A1 to the direction A2.

An opening/closing control device 504 configured to adjust an opening degree of the sub-flow path 501 may be provided on the sub-flow path 501 adjacent to the inlet port 502. The discharge direction of the air discharged from the discharge port 21 may be converted between the direction A1 and the direction A2 by selectively opening the sub-flow path 501 through the opening/closing control device 504.

In addition, as in the above-described exemplary embodiments, the opening/closing control device 504 may adjust an amount of the air, which is discharged through the outlet port 503 after passing through the sub-flow path 501, by adjusting the opening degree of the sub-flow path 501. Further, the degree of flow direction conversion of the air discharged through the discharge port 21 may be adjusted accordingly.

FIG. 10 illustrates a cross-sectional view of an air conditioner 6 according to yet another exemplary embodiment of the present invention. The air conditioner 6 according to yet another exemplary embodiment of the present invention will be described with reference to FIG. 10. However, the same reference symbols will be assigned to the same components as those in the exemplary embodiments described above, and the description thereof will be omitted.

The air conditioner 6 may control the discharged airflow by bypassing some of the air blown by the blower fan 40 to a sub-flow path 601 and then discharging the air in a direction different from that of the air discharged through the discharge port 21. On the other hand, the sub-flow path 601 may control the discharged airflow by discharging air in a direction similar to that of the air discharged through the discharge port 21. In this case, the sub-flow path 601 may be provided such that the air blown by the blower fan 40 is branched off from the main flow path P after passing through the heat exchanger 30.

The sub-flow path 601 may connect an inlet port 602 and an outlet port 603. The sub-flow path 601 may be formed along the outer wall of the housing 10 using a separate duct, or formed inside the housing 10.

The sub-flow path 601 may include a first flow path 601*a* communicating with the inlet port 602 and a second flow path 601*b* that connects the first flow path 601*a* and the outlet port 603 and extends in a circumferential direction thereof. However, such a structure of the sub-flow path 601 is given as only an example, the sub-flow path 601 is sufficient only to connect the inlet port 602 and the outlet port 603, and the structure, shape, and arrangement thereof are not limited.

The inlet port 602 may be provided on the main flow path P between the heat exchanger 30 and the discharge port 21. Accordingly, some of the air that is blown by the blower fan 40 and then passes through the heat exchanger 30 may be introduced into the sub-flow path 601 through the inlet port 602.

The outlet port 603 may be provided toward the radially outer side of the discharge port 21. The outlet port 603 may have a sectional area smaller than that of the discharge port 21. The second guide surface 14*b* in which the outlet port 603 is formed may be formed to have a step with respect to the outlet port 603. The second guide surface 14*b* may include a Coanda curved surface portion 603*a* that guides the air discharged through the outlet port 603 toward the radially outer side of the discharge port 21. The Coanda curved surface portion 603*a* may be provided to be approximately parallel with the second guide surface 14*b*, and provided to have a different slope and curvature.

According to such a configuration, the outlet port 603 may convert the flow direction of the air discharged through the discharge port 21. Specifically, the flow direction of the air discharged through the outlet port 603 is further directed to the radially outer side of the discharge port 21 than that of the air discharged through the discharge port 21.

Accordingly, the air discharged through the outlet port 603 is discharged at a high speed and induces the air discharged from the discharge port 21 to draw the air toward the outlet port 603. In other words, the discharge direction of the air discharged from the discharge port 21 is converted from the direction A1 to the direction A2.

An opening/closing control device 604 configured to adjust an opening degree of the sub-flow path 601 may be provided on the sub-flow path 601 adjacent to the inlet port 602. The discharge direction of the air discharged from the discharge port 21 may be converted between the direction A1 and the direction A2 by selectively opening the sub-flow path 601 through the opening/closing control device 604.

In addition, as in the above-described exemplary embodiments, the opening/closing control device 604 may adjust an amount of the air, which is discharged through the outlet port 603 after passing through the sub-flow path 601, by adjusting the opening degree of the sub-flow path 601. Accordingly, the degree of flow direction conversion of the air discharged through the discharge port 21 may be adjusted.

FIG. 11 illustrates a cross-sectional view of an air conditioner 7 according to yet another exemplary embodiment of the present invention. FIG. 11 illustrates an expanded view of portion O' shown in FIG. 3. The air conditioner 7 according to yet another exemplary embodiment of the present invention will be described with reference to FIG. 11. However, the same reference symbols will be assigned to the same components as those in the exemplary embodiments described above, and the description thereof will be omitted.

The air conditioner 7 may control the discharged airflow by bypassing some of the air blown by the blower fan 40 to a sub-flow path 701 and then discharging the air in a direction different from that of the air discharged through the discharge port 21. Conversely, the sub-flow path 701 may control the discharged airflow by discharging the air in a direction similar to that of the air discharged through the discharge port 21. For the purpose, the air conditioner 7 includes the sub-flow path 701 branched off from the main flow path P. The sub-flow path 701 may be provided such that the air blown by the blower fan 40 is branched off from the main flow path P before passing through the heat exchanger 30.

The sub-flow path 701 may connect an inlet port 702 through which some of the air flowing through the main flow path P is introduced and an outlet port 703 through which the air introduced through the inlet port 702 is discharged. The sub-flow path 701 may be provided to pass from the radially inner side of the discharge port 21 through the inside of the bridge 80 to the radially outer side of the discharge port 21. The sub-flow path 701 may include a first flow path 701*a* communicating with the inlet port 702 and a second flow path 701*b* that connects the first flow path 701*a* and the outlet port 703 and extends in a circumferential direction thereof. That is, the air introduced through the inlet port 702 passes through the first flow path 701*a* and the inside of the bridge 80, then passes through the second flow path 701*b*, and is discharged to the outlet port 703. However, such a structure of the sub-flow path 701 is given as only an example, the sub-flow path 701 is sufficient only to connect the inlet port 702 and the outlet port 703, and the structure, shape, and arrangement thereof are not limited.

As shown in FIG. 9, the inlet port 702 may be provided on the main flow path P between the blower fan 40 and the heat exchanger 30. Accordingly, some of the air that is blown by the blower fan 40 may be introduced into the sub-flow path 701 through the inlet port 702.

As shown in FIG. 10, the outlet port 703 may be provided toward the radially outer side of the discharge port 21. The outlet port 703 may have a sectional area smaller than that of the discharge port 21. The second guide surface 14*b* in which the outlet port 703 is formed may be formed to have a step with respect to the outlet port 703. Further, the second guide surface 14*b* may include a Coanda curved surface portion 703*a* that guides the air discharged through the outlet port 703 toward the radially outer side of the discharge port 21.

With such a configuration, the outlet port 703 may convert the flow direction of the air discharged through the discharge port 21. Specifically, the flow direction of the air discharged through the outlet port 703 is further directed to the radially outer side of the discharge port 21 than that of the air discharged through the discharge port 21.

Accordingly, the air discharged through the outlet port 703 is discharged at a high speed and induces the air discharged from the discharge port 21 to draw the air toward the outlet port 703. In other words, the discharge direction of the air discharged from the discharge port 21 is converted from the direction A1 to the direction A2.

An opening/closing control device 704 configured to adjust an opening degree of the sub-flow path 701 may be provided on the sub-flow path 701 adjacent to the inlet port 702. The discharge direction of the air discharged from the discharge port 21 may be converted between the direction A1 and the direction A2 by selectively opening the sub-flow path 701 through the opening/closing control device 704.

In addition, as in the above-described exemplary embodiments, the opening/closing control device 704 may adjust an amount of the air, which is discharged through the outlet port 703 after passing through the sub-flow path 701, by adjusting the opening degree of the sub-flow path 701. Accordingly, the degree of flow direction conversion of the air discharged through the discharge port 21 may be adjusted.

The foregoing has been shown and described with reference to specific exemplary embodiments. However, the present invention is not limited thereto, and various changes and modifications may be made by a person of ordinary skill in the art to which the present invention pertains without departing from the scope of the present invention defined in the following claims.

The invention claimed is:

1. An air conditioner comprising:

a housing including a suction port through which air is suctioned and a discharge port through which the air suctioned through the suction port is discharged, the housing further including a main flow path formed between the suction port and the discharge port;

a heat exchanger provided on the main flow path and configured to heat-exchange the suctioned air;

a blower fan configured to suction the air through the suction port, move the air suctioned through the suction port to pass through the heat exchanger, and then discharge the heat-exchanged air through the discharge port; and a sub-flow path disposed external to the housing having a first end provided around the discharge port and a second end connected to inside of the housing, wherein the blower fan is further configured to suction air around the discharge port through the first end and discharge the suctioned air received through the first end to control a flowing direction of the air discharged from the discharge port.

2. The air conditioner of claim 1, wherein the first end of the sub-flow path is an inlet port configured to suction the air around the discharge port and the second end of the sub-flow path is an outlet port configured to discharge the air suctioned through the inlet port to the inside of the housing.

3. The air conditioner of claim 2, further comprising a switch provided on the sub-flow path and configured to adjust an opening degree of the sub-flow path.

4. The air conditioner of claim 3, wherein the inlet port is provided at a radially outer side of the discharge port on the discharge port and in response to opening of the sub-flow path by the switch, the flowing direction of the air discharged from the discharge port is changed toward the radially outer side of the discharge port.

5. The air conditioner of claim 2, wherein the outlet port is provided in an upper portion of the housing, which is adjacent to the blower fan.

6. The air conditioner of claim 1, wherein the blower fan suctions air from both sides thereof in a direction of a rotation axis of the blower fan and discharges the air in a radial direction of the blower fan.

7. The air conditioner of claim 2, wherein the blower fan is configured such that one side of the blower fan in a direction of a rotation axis of the blower fan faces the suction port and an other side opposite to the one side faces the outlet port of the sub-flow path.

8. The air conditioner of claim 2, further comprising a damper provided on the sub-flow path and configured to adjust an opening degree of the sub-flow path.

9. The air conditioner of claim 8, wherein the inlet port is provided at a radially outer side of the discharge port on the discharge port and in response to opening of the sub-flow path by the damper, the flowing direction of the air discharged from the discharge port is changed toward the radially outer side of the discharge port.

* * * * *